US009412542B2

(12) United States Patent
Weber

(10) Patent No.: US 9,412,542 B2
(45) Date of Patent: Aug. 9, 2016

(54) PARTICULATE AND PRESSURE REDIRECTION SHIELD FOR AN ELECTRIC CIRCUIT BREAKER

(71) Applicant: Scott Weber, Westborough, MA (US)

(72) Inventor: Scott Weber, Westborough, MA (US)

(73) Assignee: Sensata Technologies, Inc., Attleboro, MA (US)

( * ) Notice: Subject to any disclaimer, the term of this patent is extended or adjusted under 35 U.S.C. 154(b) by 308 days.

(21) Appl. No.: 14/188,886

(22) Filed: Feb. 25, 2014

(65) Prior Publication Data

US 2015/0243460 A1 Aug. 27, 2015

(51) Int. Cl.

| | |
|---|---|
| ***H01H 33/53*** | (2006.01) |
| ***H01H 9/30*** | (2006.01) |
| ***H01H 73/18*** | (2006.01) |
| *H01H 33/88* | (2006.01) |
| *H01H 9/34* | (2006.01) |

(52) U.S. Cl.

CPC ..... *H01H 33/53* (2013.01); *H01H 9/30* (2013.01); *H01H 73/18* (2013.01); *H01H 9/342* (2013.01); *H01H 2009/305* (2013.01); *H01H 2033/888* (2013.01)

(58) Field of Classification Search

CPC ..... H01H 2009/305; H01H 2009/343; H01H 9/342; H01H 2033/888; H01H 33/72; H01H 33/73; H01H 33/74

USPC ..... 335/201

See application file for complete search history.

(56) References Cited

U.S. PATENT DOCUMENTS

| | | | | |
|---|---|---|---|---|
| 4,716,265 | A * | 12/1987 | Fujii | H01H 73/18 200/305 |
| 5,569,894 | A * | 10/1996 | Uchida | H01H 9/342 200/306 |
| 2009/0266793 | A1 * | 10/2009 | Maloney | H01H 9/36 218/149 |

* cited by examiner

*Primary Examiner* — Ramon M Barrera
(74) *Attorney, Agent, or Firm* — Chapin IP Law, LLC

(57) ABSTRACT

Featured is a particulate and pressure redirection barrier for an electrical breaker as well as a breaker embodying such a barrier. Such a barrier includes first through fifth segments, where the first segment includes a first and second side section and a bottom section that are coupled to each other so as to form a generally U shaped structure. The second segment is coupled to the first side section so it extends outwardly at an angle from the first side section. The third segment is coupled to the second side section so as to extend outwardly and at an angle from the second side section. The fourth segment is coupled to the second segment so as to extend outwardly from and at an angle with respect to the second segment. The fifth segment is coupled to the third segment so as to extend outwardly from and at an angle with respect to the third segment. Such a configuration of the fourth and fifth segments is such that gas flowing along a surface of the second or third segments is redirected at an angle with respect to that surface.

33 Claims, 15 Drawing Sheets

Tripped Condition

PARTICULATE AND PRESSURE REDIRECTION SHIELD FOR AN ELECTRIC CIRCUIT BREAKER

FIELD OF INVENTION

The present invention relates to shields or barriers for circuit breakers, more particularly to magnetic circuit breakers and more specifically to shields and barriers used to re-direct particulate debris and air pressure away from a circuit breaker mechanism during an overload event within a circuit breaker.

BACKGROUND OF THE INVENTION

A circuit breaker is a manually or automatically operated mechanical switch that is designed to protect an electrical circuit (e.g., a circuit for a telecommunications application such as a data communications circuit) or an electrical component (e.g., motor, computer, etc.) from damage caused by an overload or short circuit (e.g., fault current). The basic function of the breaker is to detect an overload condition and interrupt current flow. Circuit breakers are made in varying sizes, from small devices that protect an individual household appliance up to large switchgear designed to protect high voltage circuits feeding an entire city. Such breaker applications also include telecommunication applications, where the breakers are located at nodal locations typically in a rack system and also remote from each other.

Another device or electrical component that is used to protect from such damage is a fuse. However, a breaker is unlike a fuse which operates once and then must be replaced. A circuit breaker on the other hand is intended to be reset (either manually or automatically) to resume normal operation once it has been tripped.

All circuit breakers have common features in their operation, however, the details can vary substantially depending on the voltage class, current rating and type of the circuit breaker. In general, the circuit breaker must detect am overload condition; in what are termed low voltage circuit breakers this is usually done within the breaker enclosure. The circuit breakers for large currents or high voltages are usually arranged with a pilot device(s) to sense a fault current and to operate the trip opening mechanism. Once a fault is detected, the contacts within the circuit breaker must open to interrupt the circuit; some mechanically-stored energy (using something such as springs or compressed air) contained within the breaker is used to separate the contacts, although some of the energy required may be obtained from the fault current itself. Once the fault condition causing the tripping of the breakers has been cleared, the contacts must again be closed to restore power to the interrupted circuit.

When the current is interrupted by operation of the breaker, an arc is generated (i.e., between the moving and stationary contacts). Thus, the circuit breaker and its contacts must carry the normal operating load current without excessive heating, and must also withstand the heat of the arc produced when interrupting (opening) the circuit. The contacts typically are made of copper or copper alloys, silver alloys and other highly conductive materials. The service life of the contacts is limited by the erosion of contact material due to arcing while interrupting the current. Consequently, miniature circuit breakers (MCB) and molded-case circuit breakers (MCCB) are usually discarded when the contacts have worn.

In certain type of breakers (e.g., those that in some fashion quench the arc using air), the heat of the arc also can cause a sharp localized increase in air pressure within the breaker's enclosure. Typically the enclosure is designed with exits or ports so the pressurized air resulting from the arc is directed to the ports and so as to exit the enclosure. The breaker and its enclosure can also include other features to facilitate in the quenching of the arc (e.g., arc baffles, compressed air, vacuum, oil, etc.). In addition, such arcing also can create particulate debris.

However, despite these ports and related design features the increased air pressure within the enclosure can cause particulate debris to be dispersed within the enclosure. This can cause fouling of other components in the enclosure which can consequently also shorten the service life of the breaker and thus require an early replacement of the breaker. Pictorial views of magnetic breakers showing such fouling is provided in FIGS. 1A-C.

In addition to tripping during normal operating conditions, breakers undergo a rigorous testing process under overload and/or high interrupt current conditions to assess the operational capability of the breaker as well as assessing the breaker's capability to safely interrupt current flow under extreme conditions. This rigorous testing includes repeated short circuit tests under high current conditions. After initial qualification type testing, the circuit breakers are periodically tested in the same manner to verify continued quality of the breaker manufacture. Because such testing involves repeated testing under overload or short circuit conditions, there is a greater possibility of extensive fouling of components. Such extensive fouling also can lead to an inability of the breaker to be reset during such testing as well as the possibility that the breaker can be rendered inoperable. If the breaker is unable to be reset after tripping during such testing, this could affect the breaker's suitability for use under the desired or intended operating conditions.

There have been attempts to provide a shield or barrier to limit such fouling, however, such attempts have not proven to be completely effective. Referring now to FIG. 2A, there is shown an axonometric view of a magnetic circuit breaker with a standard sear pin trip mechanism which also includes a conventional shielding part that is mounted in proximity to a trip mechanism of the breaker. In the conventional design, the shielding part includes a generally U-shaped member that extends on either side of the trip mechanism and a shield or barrier that extends outwardly from one side of the U-shaped member. In this shielding part design portions of the trip mechanism are not covered by the shielding part.

Referring now also to FIG. 2B, there is shown an illustrative view of the shield/barrier of FIG. 2A that shows the direction of the flow paths of particulate debris and the pressurized air following a tripping or short circuit event. As indicated herein, when the breaker is tripped due to a short circuit event an arc is created causing the creation of particulates and a localized pressurizing of the air with the breaker's enclosure. In the case of the shielding part depicted in FIG. 2A, the pressurized air and particulates flow along and past the right side of the shielding part into the area of the trip mechanism. On the left side, the air is deflected by the sidewardly extending shield/barrier, but is not blocked from passing around the shield/barrier. Thus, the particulates and pressurized air can eventually enter into the trip mechanism area. Consequently, the described shielding part is not sufficiently effective to reduce fouling of the trip mechanism.

It thus would be desirable to provide a new shielding part for a breaker, in particular a magnetic breaker, and methods related thereto. It would be particularly desirable to provide such a shielding part that more effectively shields the trip mechanism from particulate debris resulting from an overload event tripping the breaker in comparison to prior art breakers. It also would be desirable to provide such a shield that can more effectively re-direct air flow from the breaker trip mechanism as compared to prior art devices. Breakers embodying such shield/barriers preferably would improve service life as compared to prior art devices as well as not require the persons maintaining such breakers, to be more highly skilled those servicing conventional breakers.

SUMMARY OF THE INVENTION

The present invention features a barrier or shield for an electric breaker (e.g., a magnetic electric breaker) as well as an electric breaker including such a barrier. More particularly, such a barrier can suitably protect or effectively block particulate debris from migrating to critical areas of the breaker resulting in the unacceptable fouling of such breaker components (e.g., the trip mechanism). Further, such a barrier can cooperate with other features within the breaker and its enclosure to facilitate the redirection of pressurized air resulting from arc event away from moving parts within the breaker and so it can suitably exit the breaker enclosure. Such a barrier and breaker are particularly suitable for use in telecommunications application such as the circuitry used in connection with data communications. It should be recognized, however, that the barrier and breaker of the present invention is not limited to only telecommunications applications.

In addition, such barriers or shields are also both easily scaled up or down, and reconfigurable to accommodate different circuit breaker design configurations and current ratings. Such a shield or barrier of the present invention also advantageously significantly decreases the contamination or fouling of a sear pin within the trip mechanism as well as decreasing the overall contamination in the mechanism chamber of a breaker particularly as compared to a breaker that has no such shield.

In its broadest aspects the present invention features a pressure redirection barrier for an electrical breaker including at least one of a first side segment and a second side segment. In further embodiments such a pressure reduction barrier further include both of the first side segment and a second side segment. As also described herein, such a pressure redirection barrier also can re-direct particulate debris being carried in the pressurized air, thereby reducing the potential for contamination and fouling.

The first side segment is arranged so as to be disposed along a first side of a tripping mechanism of the breaker. Also, the first side segment includes a first section and second section and a third section. The first section is coupled to the second section so as to extend outwardly from the first section and at an angle with respect to the first section. The third section is coupled to the second section so as to extend outwardly from the second section and at an angle with respect to the second section such that gas flowing along a surface of the third section is redirected at an angle with respect to the third section surface.

The second side segment is arranged so as to be disposed along an second side of the tripping mechanism of the breaker, where the second side opposes the first side. The fourth section is coupled to the fifth so as to extend outwardly from the fourth section and at an angle with respect to the fourth section. The sixth section is coupled to the fifth section so as to extend outwardly from the fifth section and at an angle with respect to the fifth section such that gas flowing along a surface of the fifth section is redirected at an angle with respect to the fifth section surface.

In further embodiments, the first, second and third sections are arranged so that the first and third sections oppose each other and so the three sections form an open ended structure. In addition, the fourth, fifth and sixth sections are arranged so the third and sixth sections oppose each other and so the three sections form an opened ended structure. In more particular embodiments, each of the first side segment and the second side segment is configured and arranged so as form a generally U-shaped structure section.

In yet further embodiments, such a pressure redirection barrier further includes a securing mechanism so as to secure each of the first and second side segments to the tripping mechanism and so as to maintain the orientation of each of the first and second segments with respect to the tripping mechanism.

According to one aspect of the present invention, there is featured barrier or shield (e.g., a particulate debris and pressure redirection barrier) for an electrical breaker including first through fifth segments. The first segment includes a first side section, a second side section and a bottom section, where the first and second side sections and bottom section are coupled to each other so as to form a generally U-shaped structure. The second and third segments are coupled to the first segment. In further embodiments, a length of the bottom section is different from a length of a top surface of the second and third segments as well as horizontal projections of the first and second side sections.

More specifically, the second segment is coupled to the first side section so as to extend outwardly from the first side section and at an angle with respect to the first side section. Also, the third segment is coupled to the second side section so as to extend outwardly from the second side section and at an angle with respect to the second side section. With such a configuration and arrangement, gas flowing along or parallel to a surface of either of the side sections is redirected by the respective second segment and third segment so as to be flowing at an angle with respect to the respective first segment side section.

The fourth segment is coupled to the second segment so as to extend outwardly from the second segment and at an angle with respect to the second segment. In addition, the fifth segment is coupled to the third segment so as to extend outwardly from the third segment and at an angle with respect to the third segment. With such a configuration and arrangement, gas flowing along a surface of the second segment is redirected at an angle with respect to the second segment surface and gas flowing along a surface of the third segment is redirected at an angle with respect to the third segment surface. Also, the outwardly extending portions of the second and third segments extend lengthwise so as to cover substantial portions of the trip mechanism of the breaker.

In yet further embodiments, the second through fifth segments in combination with the respective first or second side sections are arranged so as to form a second and a third generally U-shaped structure. In this way, gas and/or particulates (e.g., particulate debris) flowing across the surface of the first or second side sections is/are generally re-directed by these U-shaped structures so that the gas/particulates are redirected to flow in a direction generally opposite to the gas flowing across the surface of the first or second side sections. Such structures thus facilitate the redirection of pressurized air and particulate debris resulting from arcing away from certain features of the breaker (e.g., critical and/or moving features within the breaker) and so the pressurized air and particulate debris can suitably exit the breaker's enclosure.

According to another aspect of the present invention, there is featured a circuit breaker including a trip or tripping mechanism that causes the breaker to interrupt current flow in the presence of unacceptable transient or operating conditions (e.g., overload or short circuit conditions); and shield or barrier (e.g., a particulate and pressure redirection barrier or shield) arranged so as to be maintained in a desired orientation with respect to the tripping mechanism. More particularly, such a particulate and pressure redirection barrier includes first through fifth segments.

The first segment includes a first side section, a second side section and a bottom section, where the first and second side sections and bottom section are coupled to each other so as to form a generally U-shaped structure. The second and third segments are coupled to the first segment. In further embodiments, a length of the bottom section is different from a length of a top surface of the second and third segments as well as horizontal projections of the first and second side sections.

More specifically, the second segment is coupled to the first side section so as to extend outwardly from the first side section and at an angle with respect to the first side section. Also, the third segment is coupled to the second side section so as to extend outwardly from the second side section and at an angle with respect to the second side section. With such a configuration and arrangement, gas flowing along or parallel to a surface of either of the side sections is redirected by the respective second segment or third segment so as to be flowing at an angle with respect to the respective first segment side section. Also, the outwardly extending portions of the second and third segments extend lengthwise so as to cover substantial portions of the trip mechanism of the breaker.

The fourth segment is coupled to the second segment so as to extend outwardly from the second segment and at an angle with respect to the second segment. With such a configuration and arrangement, gas flowing along a surface of the second segment is redirected at an angle with respect to the second segment surface. In addition, the fifth segment is coupled to the third segment so as to extend outwardly from the third segment and at an angle with respect to the third segment. As indicated above, with such a configuration and arrangement, gas flowing along a surface of the third segment is redirected at an angle with respect to the third segment surface. In further embodiments, the fourth and fifth segments extend along the length of the respective second and third segments.

In embodiments of the particulate debris and pressure redirection barrier and the circuit breaker of the present invention, the first through fifth segments for such a particulate debris and pressure redirection barrier are sized such that when then the first through fifth segments are oriented with respect to a trip mechanism of the electrical breaker, the segments form a pressure redirection barrier that re-directs a flow of pressurized gas, such as that resulting from an overload event, towards the exhaust ports of the breaker.

In yet further embodiments, the first through fifth segments are sized and oriented so that particulate debris generated by an arc associated with a short circuit event are substantially redirected from penetrating the operating mechanism. In sum, the first through fifth segments are configurable so as to substantially reduce the potential for fouling of the trip mechanism as well as other structures or functionalities of the breaker.

In yet further embodiments the first segment further includes a front end and a rear end. The first and second side sections also are configured such that an edge thereof slopes at an angle from the front end to the rear end, whereby a top surface for each of the second and third segments forms a sloping surface.

In yet further embodiments, the first, fourth and fifth segments are arranged such that the fourth segment parallels an opposing surface of the first side section and such that the fifth segment parallels an opposing surface of the second side section.

In yet further embodiments, the particulate debris and pressure redirection barrier and circuit breaker of the present invention include a securing mechanism that secures the first segment to the electrical breaker so that the first through fifth segments are maintained in a desired orientation with respect to a trip or tripping mechanism of the breaker.

In further embodiments, the second and fourth segments and the third and fifth segments are arranged in combination with the respective first or second side sections of the first segment to form two generally U-shaped structures. In more particular embodiments, the first through fifth segments are arranged so as to form a central U-shaped structure and two outer U-shaped structures where the open end of the central U-shaped structure is opposite to the open end of the outer U-shaped structures.

In yet further particular embodiments, the central U-shaped structure is arranged so as to be disposed about at least a major portion of the tripping mechanism. Also, each of the two outer U-shaped structures are arranged so as to extend outwardly from the tripping mechanism to occlude or block at least portions of the open area extending outwardly from the top and bottom sides of the tripping mechanism (i.e., the area extending from the first and second side sections of the first segment).

In yet more specific embodiments, the first segment is dimensioned so as to extend over significant portions of the tripping mechanism so as to directly shield the tripping mechanism from particulates and the pressurized gas associated with arcing. In this regard, the term significant portions of the tripping mechanism shall be understood to mean covering vertical and horizontal surfaces of the tripping mechanism to the maximum extent possible without impinging on or interfering with the operation of the tripping mechanism responsive to an overload or high current condition or other functionalities of the electrical breaker.

In yet more specific embodiments, the second and third segments are each dimensioned so as to occlude or block significant portions of the open area within the breaker that extend outwardly from opposing sides (e.g., the top and bottom sides) of the tripping mechanism (i.e., the area extending from the first and second side sections of the first segment). In this regard, the term significant portions of the open area shall be understood to mean blocking or occluding the open areas extending from either of the top or bottom side of the tripping mechanism to the maximum extent possible without impinging on or interfering with the operation of the tripping mechanism responsive to an overload or high current condition or other functionalities of the electrical breaker.

In yet more specific embodiments, the fourth and fifth segments are each dimensioned and arranged in combination with the respective second and third segments and the respective first and second sections of the first segment so the fourth and fifth segments respectively form a side of the respective outer U-shaped structure extending outwardly from the respective second and third segment. According to an aspect of the present invention, the fourth and fifth segments are dimensioned so that this side extends sufficiently outwardly to occlude or block the flow of the gas flowing across the surface of the respective second and third segment so as to at least minimize or eliminate the potential for the gas from flowing around the respective second and third segments into certain open areas of the breaker.

In more particular embodiments, the fourth and fifth segments also are dimensioned so as to extend lengthwise along a sufficient length of the respective second and third segments also so as to at least minimize or eliminate the potential for the gas from flowing around the respective second and third segments into the certain open areas. In addition, the fourth and fifth segments also are dimensioned so that the side also re-directs the flow of gas in a direction that roughly parallels the fourth and fifth segments.

In this way, gas and/or particulates flowing across the surface of the first or second side sections of the first segment is/are generally re-directed by the outer U-shaped structures so that the gas/particulates are re-directed to flow in a direction generally opposite to the gas flowing across the surface of the first or second side sections of the first segment. Such a structure thus facilitates the re-direction of pressurized air and particulate debris resulting from arcing away from certain features of the breaker including the tripping mechanism, and also so the pressurized air and particulates can suitably exit the breaker's enclosure thereby at least minimizing the potential for fouling of specific functionalities of the breaker.

As indicated herein, the second and third segments are at an angle ($\theta_2$, $\theta_3$) with respect to the respective first and second side sections of the first segment and the fourth and fifth segments are at an angle ($\theta_4$, $\theta_5$) with respect to the respective second and third segments. In particular embodiments, the second and third segments are about perpendicular to the respective first and second side sections of the first segment and the fourth and fifth segments are about perpendicular to the respective second and third segments. While an about perpendicular angle is preferable, this is not limiting as the segments/sections can be arranged so as to be at or about any of a number of angles.

In yet further embodiments, each of the angle $\theta_2$ between the second segment and the first side section, the angle $\theta_3$ between the third segment and the second side section, the angle $\theta_4$ between the fourth segment and the second segment and the angle $\theta_5$ between the fifth segment and the third segment satisfies one of the following relationships: $70° \leq \theta_2 \leq 110°$; $80° \leq \theta_2 \leq 100°$; $\theta_2$ is about $90° \pm 5°$; or $\theta_2$ is about $90° \pm 1°$. It should be recognized, however, that the particular angle(s) selected for use shall be such that the second through fifth segments in combination with the first and second side sections of the first segment cooperate to re-direct the flow of the pressurized gas and particulates and form a barrier to the flow of such gas and particulates to minimize or prevent fouling of functionalities as herein described while not inhibiting or affecting the tripping mechanism or other functionalities of the breaker from functioning in the intended manner.

In yet further embodiments, the second and third segments have a top surface that is defined by a length ($L_{top}$) and each are defined by a width ($W_2$, $W_3$). The length and width of these segments are generally established so as to occlude or block significant portions of the open area extending outwardly from the top and bottom sides of the tripping mechanism (i.e., the area extending from the first and second side sections of the first segment) along the length of the tripping mechanism. In more particular embodiments, the length of the top surface ($L_{top}$) as described herein is generally maximized to cover significant portions of the tripping mechanism, more specifically the length is maximized based on the available length ($L_{link}$) of the link housing for the breaker. In more particular embodiments, the length ($L_{top}$) and widths ($W_2$, $W_3$) of the second and third segments also are established so as not to inhibit or affect the tripping mechanism or other functionalities of the breaker from functioning in the intended manner.

As also indicated herein, in embodiments of the present invention the top surface is oriented so as to form a sloping surface that slopes between a front end and rear end of the first segment. In more particular embodiments, the sloping angle ($\theta_1$) is determined based on the fit of shield or barrier to the link housing and the tripping mechanism as well as not inhibiting or affecting the tripping mechanism or functionalities of the breaker from functioning in the intended manner. In illustrative embodiments, the sloping angle $\theta_1$ satisfies one of the following relationships: $5° \leq \theta_1 \leq 20°$; $10° \leq \theta_1 \leq 15°$ or the $\theta_1 \approx 10°$ (i.e., sloping angle $\theta_1$ is about 10°).

In yet further embodiments, an electrical breaker according to the present invention further includes at least one exhaust port and where the first through fifth segments are sized such that when the first through fifth segments are oriented with respect to the trip or operating mechanism, the segments form a pressure redirection barrier that re-directs a flow of pressurized gas, resulting from arcing of the electrical breaker, towards the at least one exhaust port. More particularly, the first through fifth segments are oriented so that the pressurized gas associated with a short circuit event is substantially re-directed away from the tripping mechanism. In addition, the first through fifth segments are sized and oriented so that particulate debris also being generated or created by the arc are substantially redirected from penetrating the trip mechanism.

Other aspects and embodiments of the invention are discussed below.

DEFINITIONS

The instant invention is most clearly understood with reference to the following definitions:

The terms "electrical breaker," "circuit breaker" or breaker are used interchangeably herein and either term shall be understood to be referring to a manually or automatically operated mechanical switch that is designed to protect an electrical circuit (e.g., a circuit for a telecommunications application such as a data communications circuit) or an electrical component (e.g., motor, computer, digital signal processor, application specific integrated circuit (ASIC), etc.) from damage caused by an overload or short circuit.

The term "magnetic circuit breaker" shall be understood to be referring to a circuit breaker that embodies or uses a solenoid or electromagnet whose pulling force increases with the current. In such a breaker, the circuit breaker contacts are held closed by a latch. As the current in the solenoid increases beyond the rating of the circuit breaker, the solenoid causes an armature to rotate and trip the sear lever which release the latch, which lets the contacts open by spring action. In some designs, the magnetic breakers also incorporate a hydraulic time delay feature using a viscous fluid and a spring that restrains the core until the current exceeds the breaker rating. During an overload condition, the speed of the solenoid motion is restricted by the fluid and this delay permits brief current surges beyond normal running current such as for motor starting, energizing equipment, etc. In the case of a high or extreme overload currents, however, such currents provide a sufficient solenoid force to release the latch regardless of the core position thus bypassing the delay feature.

The terms "particulate debris," particulate" and "particulate contaminants" as used herein, particularly when used in combination with a discussion of the shield or barrier of the present invention, shall be understood to include particulates created when the contacts of the breaker are opened due to an overload or high/extreme current condition. This also shall include particulates created by the arc that typically occurs when the stationary and moving contacts are being opened and/or are opened.

The term "trip mechanism" or "tripping mechanism" are used interchangeably herein and either term shall be understood to be referring to the mechanism with an electrical breaker that separates the breaker's contacts or the like that interrupts the current flow responsive to an overload or short circuit current condition.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein.

DESCRIPTION OF THE PREFERRED EMBODIMENT

Figure 3A:
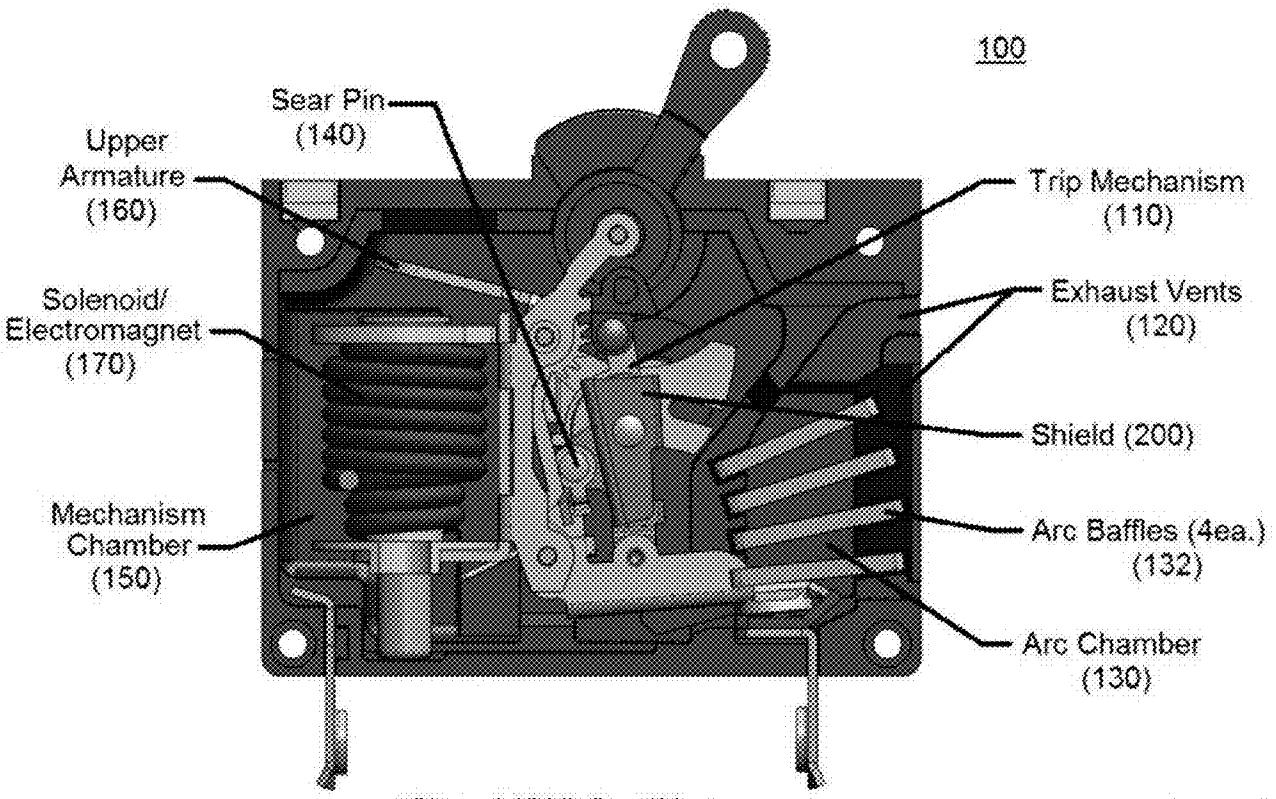
FIGS. 3A-C are various illustrative views of a magnetic breaker configured with shield or barrier (e.g., a dust and pressure redirection shield/barrier) according to an aspect of the present invention when in the Closed or ON Condition (FIG. 3A), in the Open (OFF) or Reset Condition (FIG. 3B) and in the Tripped Condition (FIG. 3C).
Figure 3B:
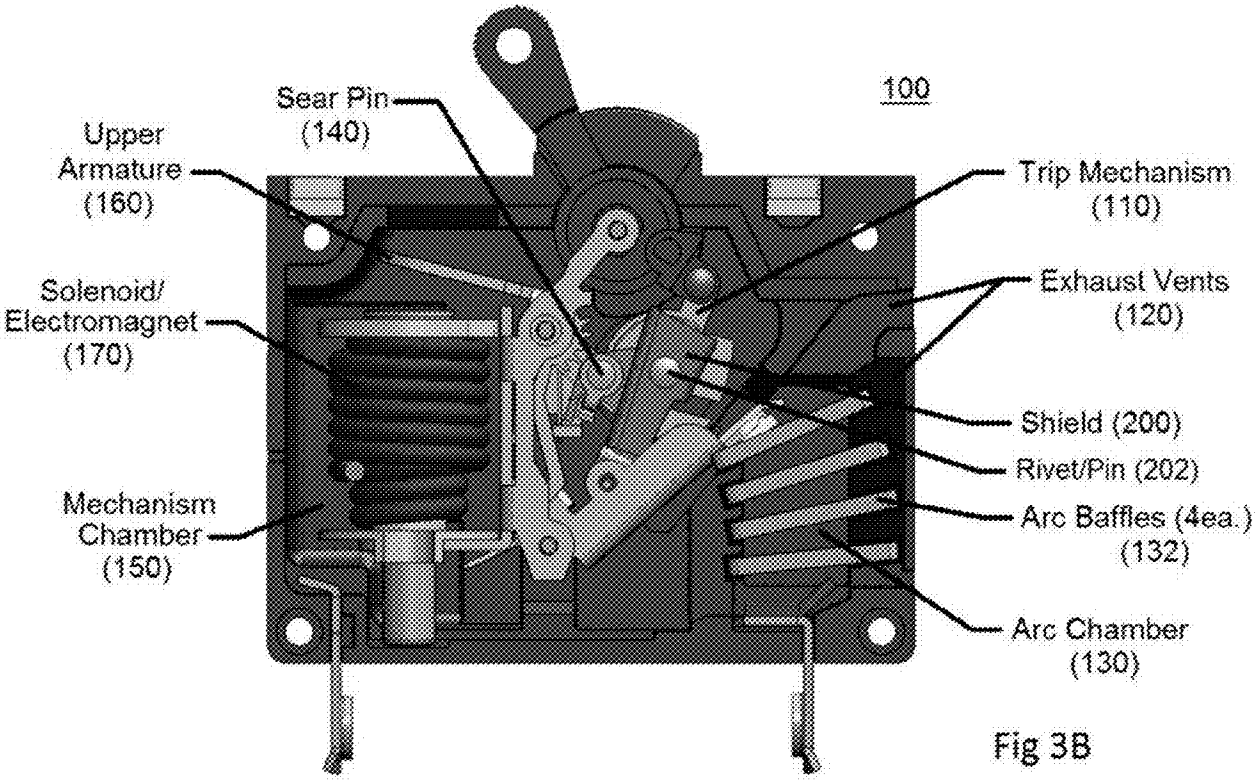
Figure 3C:
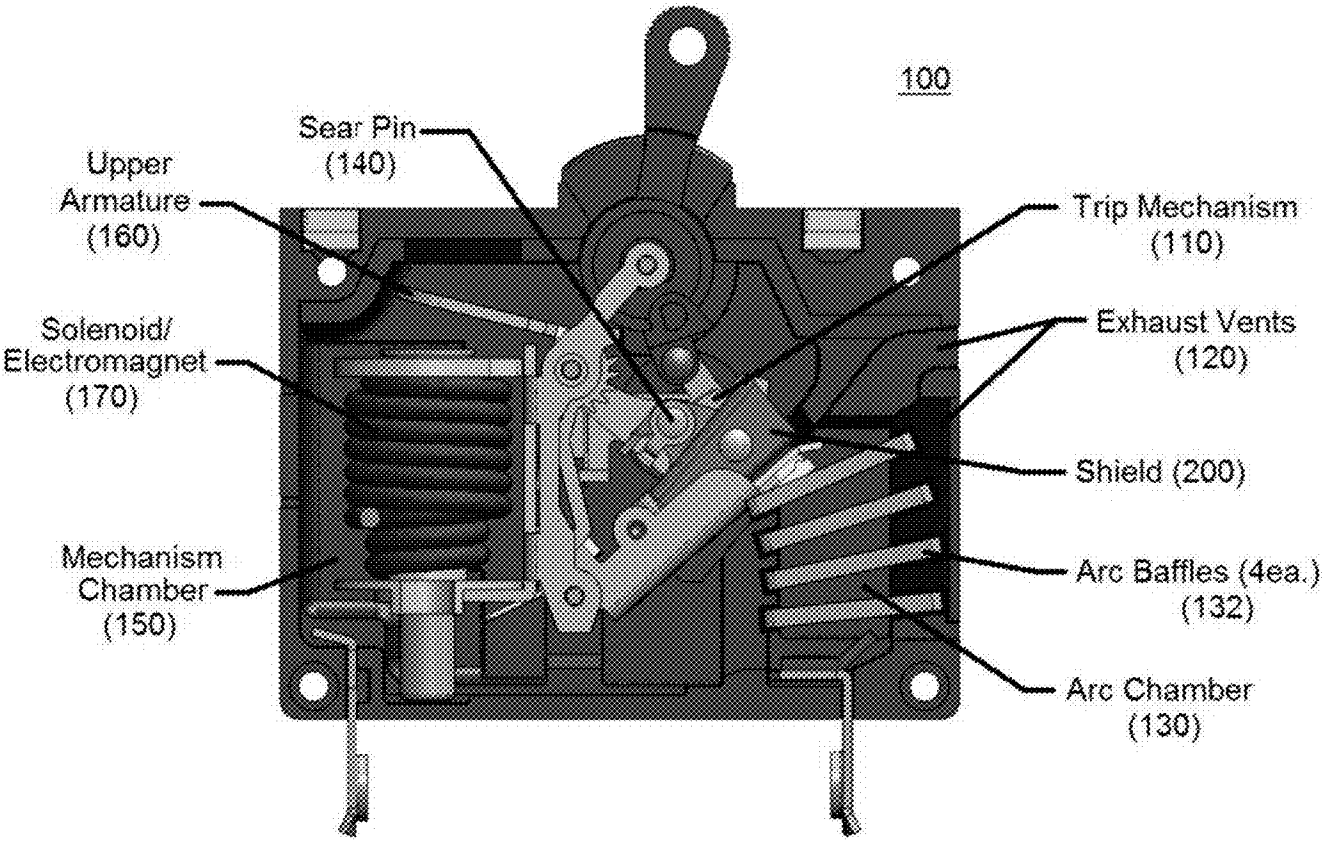

Referring now to the various figures of the drawing wherein like reference characters refer to like parts, there is shown in FIGS. 3A-C various illustrative views of a magnetic breaker 100 configured with a shield or barrier (e.g., a particulate and pressure redirection shield/barrier) 200 according to an aspect of the present invention; when in the Closed or ON Condition (FIG. 3A), in the Open (OFF) or Reset Condition (FIG. 3B) and in the Tripped Condition (FIG. 3C). In the following this feature of the present invention is interchangeably referred to as a shield, a barrier, a particulate and pressure redirection shield/barrier or a particulate debris and pressure redirection shield/barrier, and thus no limitation shall be assumed because of the specific language being used in the following or the claims. Although a magnetic breaker is illustrated and described, it should be recognized that the shield or barrier of the present invention is adaptable for use with any of a number of breakers as are known in the art including those being susceptible to fouling from arcing or the like when the breaker is tripped. In exemplary embodiments, the shield or barrier of the present invention is easily adaptable for use with any type of Airpax/Sensata circuit breaker as well as other breaker known in the art having a trip mechanism such as that described and shown in the figures of the subject application.

The magnetic breaker 100 being illustrated is a magnetic breaker with a standard sear pin trip mechanism as is known in the art that is further configured to include a shield or barrier 200 according to the present invention to prevent or at least significantly decrease particulate contamination (e.g., decreasing transmission of particulate debris) generated by the arc from penetrating at least the trip mechanism of the breaker. In yet further aspects, the shield or barrier significantly decreases overall contamination in the breaker's mechanism chamber as compared to a breaker without a shield. In addition, such a shield or barrier 200 includes a geometry and/or is configured so the shield acts to redirect the increased air pressure also generated by the arc event away from at least the trip mechanism 110.

In the illustrated embodiment, a rivet or pin 202 is provide to mechanically secure the shield 200 to the operating mechanism such that the shield is maintained in fixed or secure relation to it. In this regard, any of a number of mechanisms or means known in the art (e.g., nuts, bolts, studs) can be used for so mechanically securing the shield 200 so that it is maintained in fixed or secure relation to the trip mechanism 110.

As further illustrated, such a magnetic breaker 100 includes a trip mechanism 110, exhaust vent(s) 120, an arc chamber 130, an arc baffle 132, a sear pin 140, a mechanism chamber 150, an upper armature 160 and a solenoid 170 or electromagnet. As is known to those skilled in the art, a number of the functionalities of the breaker including the trip mechanism 110, the sear pin 140, the upper armature 160 and the solenoid or electromagnet 170 are disposed with the breaker enclosure within the mechanism chamber 150. Such a mechanism chamber is arranged and sized so that these functionalities are operationally retained therein and to generally protect these functionalities from unwanted environmental effects. Preferably, the mechanism chamber 150 also is arranged so as to minimize the increased air pressure and particulates associated with an arcing event from gaining easy and ready access to the mechanism chamber.

Figure 1A:
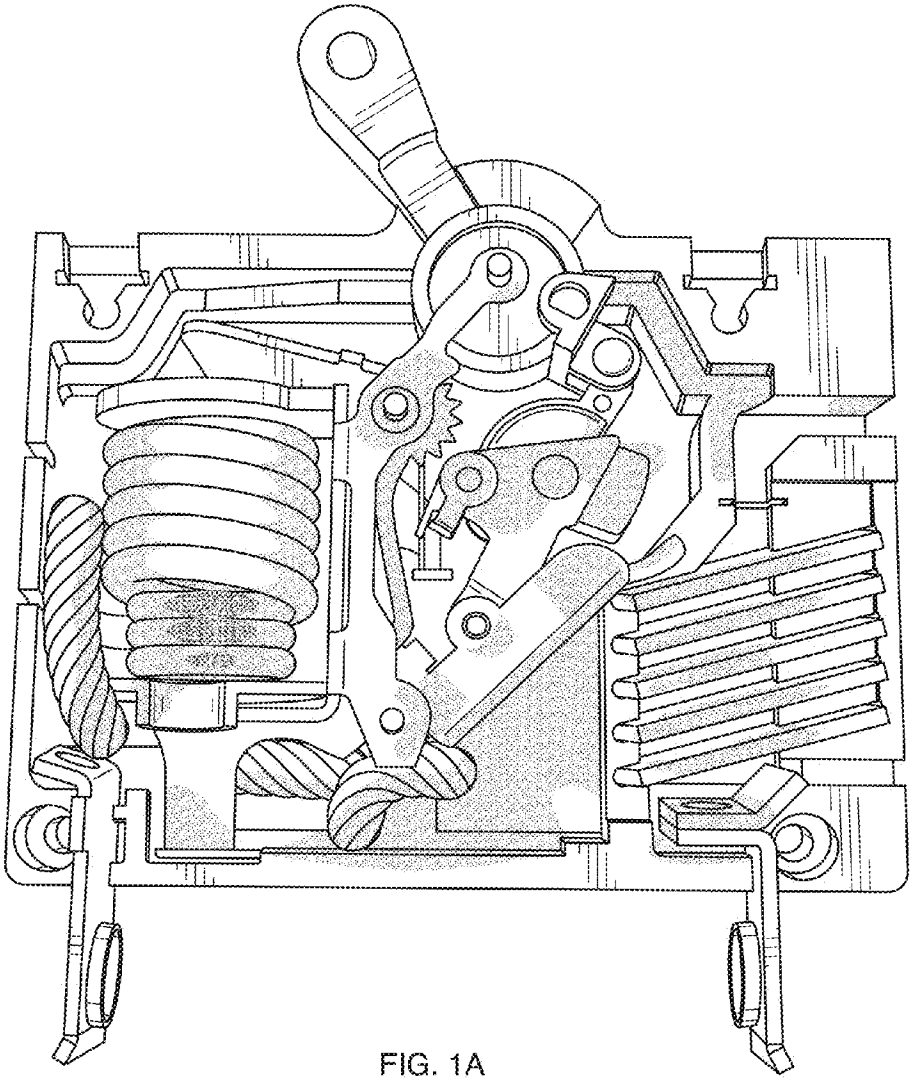
FIGS. 1A-C are various pictorial views of magnetic breakers illustrating fouling of the breaker including the trip mechanism following several overload incidents.
Figure 1B:
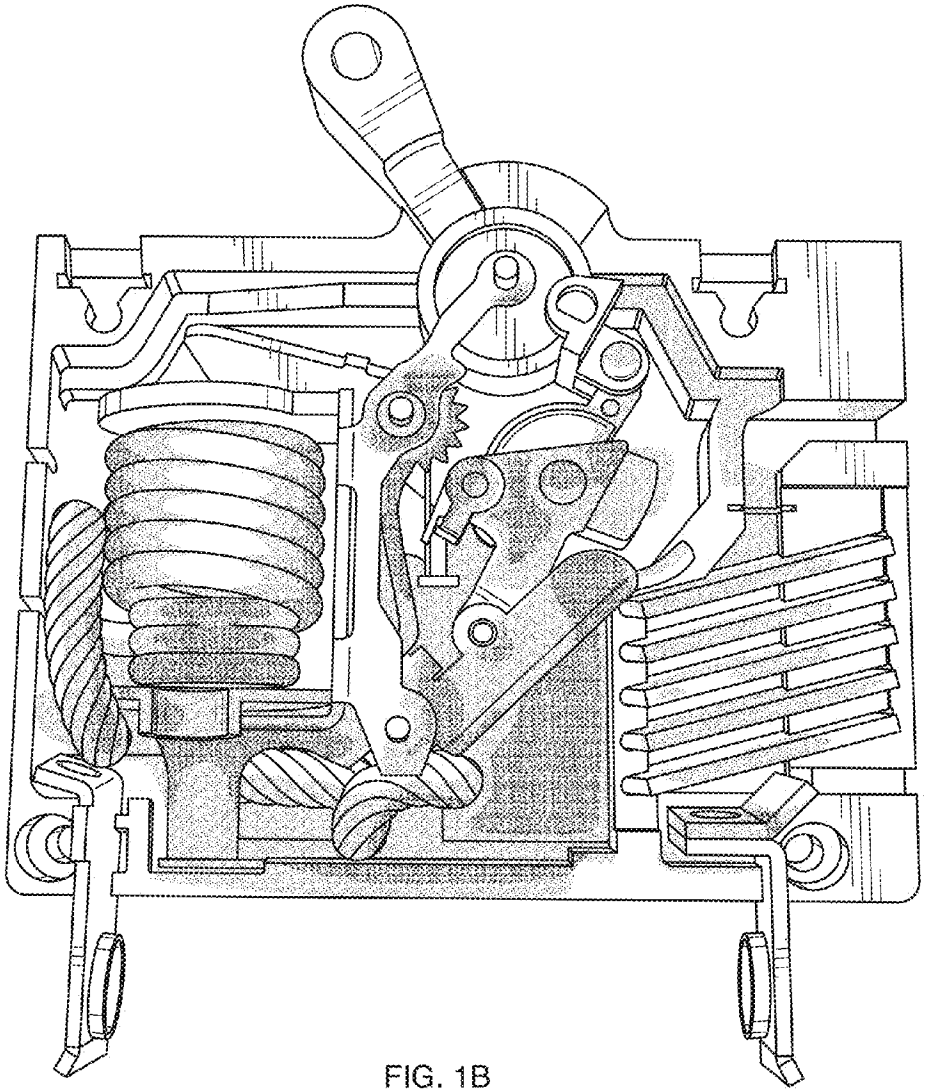
Figure 1C:
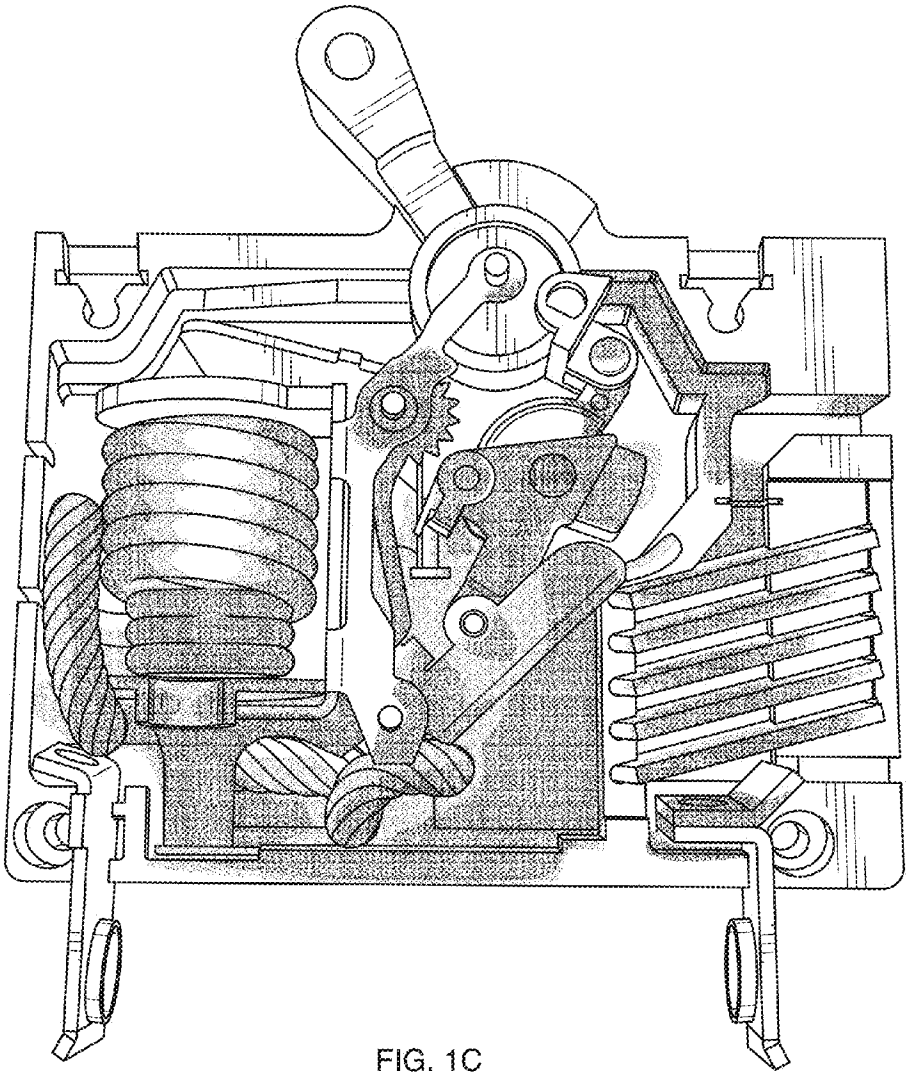
Figure 6:
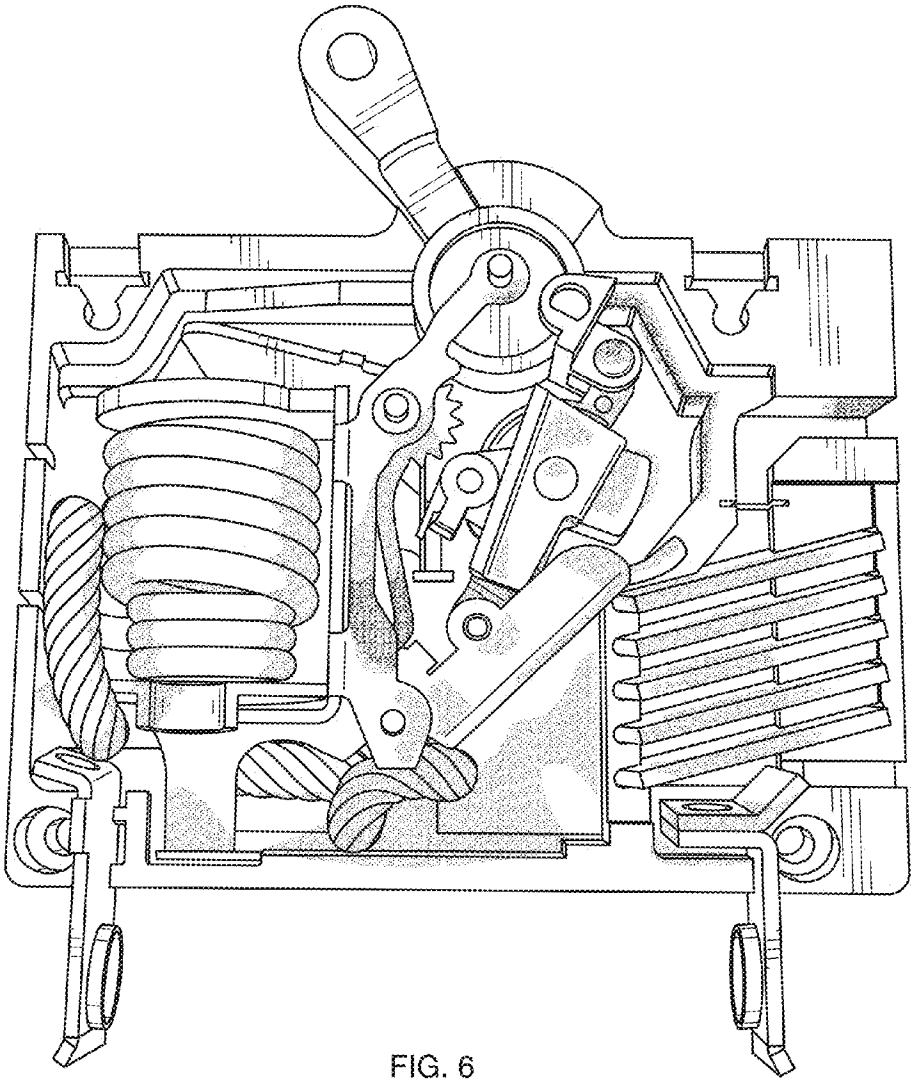
FIG. 6 is a pictorial view of a magnetic breaker configured with a shield according to the present invention and shown following several overload incidents.

As is also known in the art, the arc chamber 130 and arc baffle 132 are provided so as to form a mechanism that quenches the arc created when the breaker is tripped to cut off the flow of current when an overload or short circuit condition is detected by the breaker. Also, the exhaust vent(s) 120 are provided to vent or exhaust the increased pressure and any particulate debris associated with breaker arcing when tripping of the breaker occurs. Therefore, it is expected that these areas of the breaker will exhibit some indication of the interaction of the arc and/or particulates with these features such as shown in FIGS. 1 and 6. However, any such indications in these areas is tolerable as it is expected that these areas will come into contact with the increased air pressure, arc and particulates resulting from breaker arcing when the breaker is tripped. Moreover, as these areas are in effect isolated from the trip mechanism by the shield/barrier 200 of the present invention, such exposure of these features should not affect operation of the trip mechanism and/or the proper operation of the breaker in general.

As indicated herein, a magnetic circuit breaker typically embodies or uses a solenoid 170 or electromagnet who's pulling force increases with the current. In such a breaker, the circuit breaker contacts are held closed by a latch. As the current in the solenoid 170 increases beyond the rating of the circuit breaker, the pull of the solenoid releases the latch (i.e., pulls on the upper armature 160 thereby releasing the latch restraining the trip mechanism 110). Once the latch is released, the trip mechanism 110 can function and thus also allow the contacts to open (e.g., by spring action) to cut off the flow of current.

As also described herein, in some designs, magnetic breakers also can incorporate a time delay feature (e.g., a hydraulic time delay feature using a viscous fluid and a spring) that restrains the core of the solenoid) until the current exceeds the breaker rating. Thus, during an overload condition, the speed of the solenoid's motion is restricted by the fluid and this delay permits brief current surges beyond normal running current such as for motor starting, energizing equipment, etc. without causing the latch to be released. In the case of short circuit currents, however, such currents provide a sufficient force to release the latch regardless of the core position thus bypassing the delay feature.

Figure 4A:
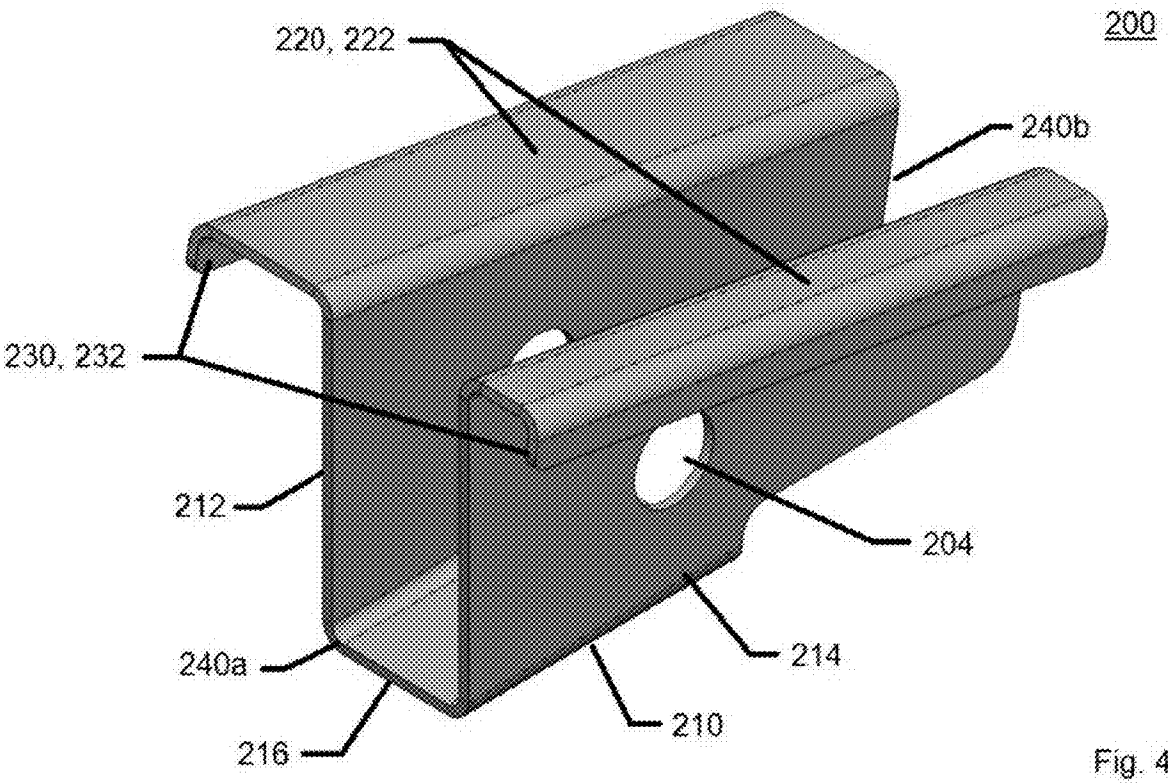
FIG. 4A is an axonometric view of a shield or barrier (e.g., a particulate and pressure redirection shield) according to the present invention for a trip mechanism of an electrical breaker.
Figure 4B:
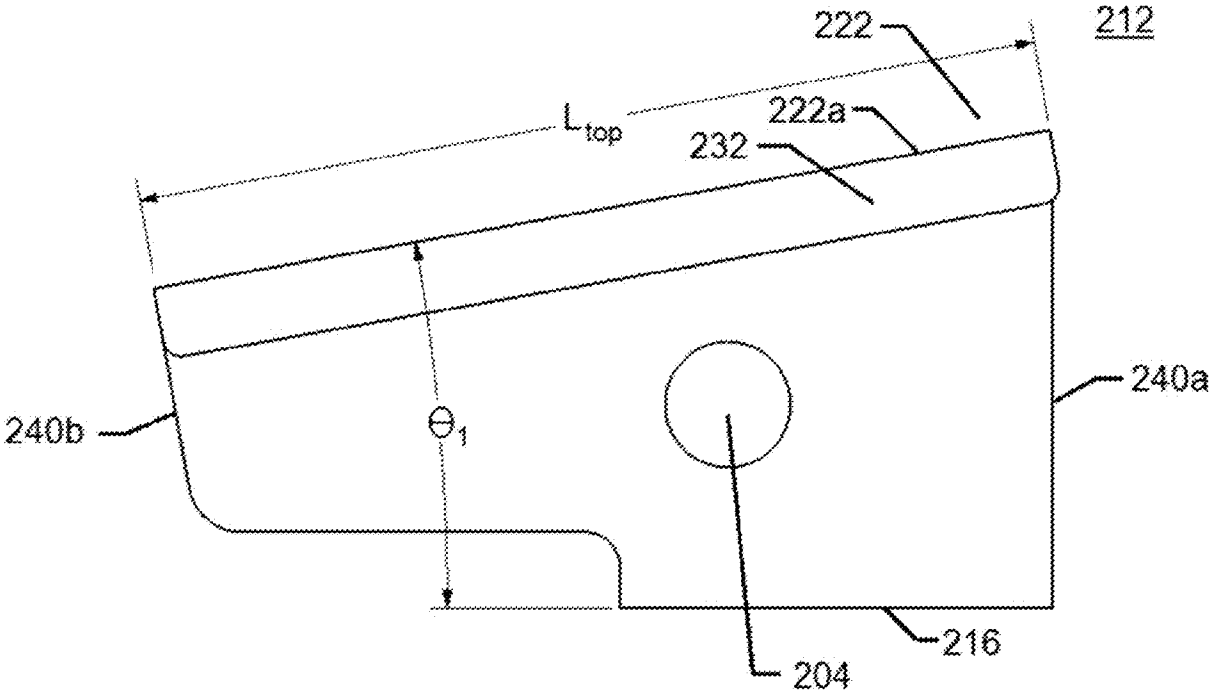
FIG. 4B is a side view of the shield or barrier of FIG. 4A.
Figure 4C:
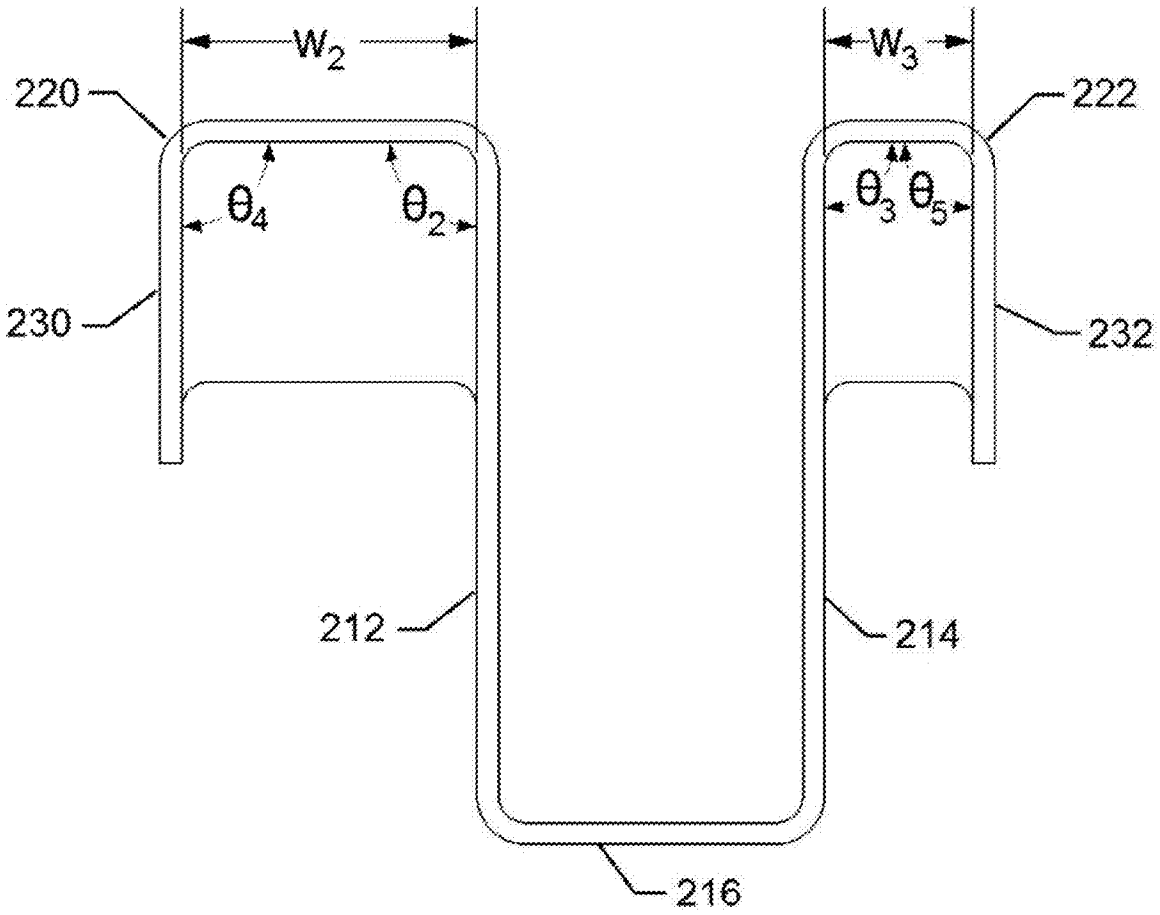
FIG. 4C is an end view of the shield or barrier of FIG. 4B.

As indicated herein such a breaker 100 is configured to include a shield 200 that is secured within the enclosure of the breaker and so that the shield is maintained in fixed or secure relation to the trip mechanism 110. Referring now to FIGS. 4A-C, there is shown: an axonometric view of a shield 200 (e.g., a particulate and pressure redirection shield) according to the present invention for a trip mechanism of an electrical breaker, a side view of the shield of FIG. 4A, and an end view of the shield of FIG. 4B.

Such a shield 200 includes five segments, namely first through fifth segments 210, 220, 222, 230, 232. The first segment 210 includes three sections; a first side section 212, a second side section 214 and a bottom section 216 that are coupled or joined to each other so that the first segment forms a generally U-shaped structure. It should be recognized that these three sections can be joined to each other so as to form any of a number of shapes or geometries known in the art that are otherwise appropriate for the intended use as well as the geometry of the breaker, more specifically the configuration and arrangement of the trip mechanism. Each of the first and second side sections 212, 214 includes an aperture 204 therein that cooperate with the rivet or pin 202 to secure the shield 200 to the trip mechanism.

In exemplary illustrative embodiments, the first and second side sections 212, 214 generally extend between the front and rear ends 240*a, b* of the shield 200. Also, the second and third segments 220, 222 are joined or coupled respectively to each of the first and second side sections 212, 214 so as to extend outwardly from the respective first side section 220 and second side section 222. In exemplary embodiments, the second and third segments extend outwardly along the length of the respective first and second side sections of the first segment, however this is not limiting as they can extend outwardly along a part of this length.

Each of the second and third segments 220, 222 include a top surface 220*a*, 222*a* that is more particularly configured so as slope at an angle $\theta_1$ between the front and rear ends 240*a, b* of the shield and also defined by a length $L_{top}$. More specifically the angle is defined between the horizontal extension of the bottom section 216 of the first segment 210 and the top surface 220*a*, 222*a* of the top surface respectively of the second and third segments. The length $L_{top}$ and angle is hereinafter described in more detail.

The fourth and fifth segments 230, 232 are coupled to or are joined respectively to each of the second and third segments 220, 222 so as to extend outwardly from the respective second and third segments and at an angle ($\theta_2$ and $\theta_3$) with respect to the respective second and third segments. These angles are hereinafter described in more detail.

In illustrative, exemplary embodiments, the second, third, fourth and fifth segments 220, 222, 230, 232 are oriented with respect to the respective first and second side sections of the first segment so the fourth and fifth segments parallel an opposing surface of the respective first and second side sections. In this way, the second, third, fourth and fifth segments and the respective first and second side sections of the first segment are arranged so as to form two generally U-shaped structures (i.e., two outer U-shaped structures). In yet further embodiments, these two generally U-shaped structures are arranged (i.e., the open end of the U) so as to be opposite in direction to the U-shaped structure (i.e., a centrally located U-shaped structure) forming the first segment. The widths of structures forming the second, third, fourth and fifth segments 220, 222, 230, 232 are hereinafter described in more detail.

In yet further embodiments, the second through fifth segments are arranged so as to form a generally U-shaped structure in combination with the respective first or second side sections. In this way, the gas and/or particulates flowing across the surface of the first or second side sections is/are generally re-directed by the structures formed by the second through fifth segments so that the gas/particulates are redirected to flow in a direction generally opposite to the gas flowing across the surface of the first or second side sections. Such a structure thus facilitates the redirection of pressurized air and particulate debris resulting from arcing away from certain features of the breaker and so the pressurized air and particulates can suitably exit the breaker's enclosure.

In further embodiments, the second and fourth segments and the third and fifth segments are arranged in combination with the respective first or second side sections of the first segment to form two generally U-shaped structures. In more particular embodiments, the first through fifth segments are arranged so as to form a central U-shaped structure and two outer U-shaped structures where the open end of the U of the central U-shaped structure is opposite to the open end of the outer U-shaped structures.

In yet further particular embodiments, the central U-shaped structure is arranged so as to be disposed about at least a major portion of the tripping mechanism. Also, each of the two outer U-shaped structures are arranged so as to extend outwardly from the tripping mechanism to occlude or block at least portions of the open area extending outwardly from the top and bottom sides of the tripping mechanism (i.e., the area extending from the first and second side sections of the first segment).

In yet more specific embodiments, the first segment is dimensioned so as to extend over significant portions of the tripping mechanism so as to directly shield the tripping mechanism from particulates and the pressurized gas associated with arcing. In this regard, the term significant portions of the tripping mechanism shall be understood to mean covering vertical and horizontal surfaces of the tripping mechanism to the maximum extent possible without impinging on or interfering with the operation of the tripping mechanism responsive to an overload or high current condition or other functionalities of the electrical breaker.

In yet more specific embodiments, the second and third segments are each dimensioned so as to occlude or block significant portions of the open area within the breaker's enclosure that extend outwardly from opposing sides (e.g., the top and bottom sides) of the tripping mechanism (i.e., the area extending from the first and second side sections of the first segment). In this regard, the term significant portions of the open area shall be understood to mean blocking or occluding the open areas extending from either of the top or bottom side of the tripping mechanism to the maximum extent possible without impinging on or interfering with the operation of the tripping mechanism responsive to an overload or high current condition or other functionalities of the electrical breaker.

In yet more specific embodiments, the fourth and fifth segments are each dimensioned and arranged in combination with the respective second and third segments and the respective first and second sections of the first segment so the fourth and fifth segments respectively form a side of the respective outer U-shaped structure extending outwardly from the respective second and third segment. The respective first and second sections also respectively form an opposing side of the respective outer U-shaped structure. According to an aspect of the present invention, the fourth and fifth segments are dimensioned so that this side extends sufficiently outwardly to occlude or block the flow of the gas flowing across the surface of the respective second and third segment so as to at least minimize or eliminate the potential for the gas from flowing around the respective second and third segments into certain open areas of the breaker.

In more particular embodiments, the fourth and fifth segments also are dimensioned so as to extend lengthwise along a sufficient length of the respective second and third segments also so as to at least minimize or eliminate the potential for the gas from flowing around the respective second and third segments into the certain open areas. In addition, the fourth and fifth segments also are dimensioned so that the side also re-directs the flow of gas in a direction that roughly parallels the fourth and fifth segments.

In this way, gas and/or particulates (e.g., particulate debris) flowing across the surface of the first or second side sections of the first segment is/are generally re-directed by the outer U-shaped structures so that the gas/particulates are re-directed to flow in a direction generally opposite to the gas flowing across the surface of the first or second side sections of the first segment. Such a structure thus facilitates the re-direction of pressurized air and particulate debris resulting from arcing away from certain features of the breaker including the tripping mechanism, and also so the pressurized air and particulates can suitably exit the breaker's enclosure thereby at least minimizing the potential for fouling of specific functionalities of the breaker.

In illustrative, exemplary embodiments, the bottom section 216 is configured so as to extend part way along the length of the first and second side sections 212, 214, however this shall not be limiting. The bottom section 216 is configurable so as to extend lengthwise any distance from the front end 240*a* of the shield dependent upon the available space provided by the trip mechanism 110, other structure of the breaker or its enclosure, and/or for the operation of the trip mechanism, particularly movement of the trip mechanism when it is tripped.

In further illustrative exemplary embodiments, each of the first and second side sections 212, 214 further includes a step starting proximal the end of the bottom section 216 and extending to the back end of the 240*b* of the shield. Such a step can be provided and sized so as to allow for movement of the trip mechanism and the shield in the event the trip mechanism is tripped.

As indicated herein, the second and third segments are at an angle ($\theta_2$, $\theta_3$) with respect to the respective first and second side sections of the first segment and the fourth and fifth segments are at an angle ($\theta_4$, $\theta_5$) with respect to the respective second and third segments. In particular embodiments, the second and third segments are about perpendicular to the respective first and second side sections of the first segment and the fourth and fifth segments are about perpendicular to the respective second and third segments. While an about perpendicular angle is preferable, this is not limiting as the segments/sections can be arranged so as to be at or about any of a number of angles.

In yet further embodiments, each of the angle $\theta_2$ between the second segment and the first side section, the angle $\theta_3$ between the third segment and the second side section, the angle $\theta_4$ between the fourth segment and the second segment and the angle $\theta_5$ between the fifth segment and the third segment satisfies one of the following relationships: $70° \leq \theta_2 \leq 110°$; $80° \leq \theta_2 \leq 100°$; $\theta_2$ is about $90° \pm 5°$; or $\theta_2$ is about $90° \pm 1°$. It should be recognized, however, that the particular angle(s) selected for use shall be such that the second through fifth segments in combination with the first and second side sections of the first segment cooperate to re-direct the flow of the pressurized gas and particulates and form a barrier to the flow of such gas and particulates to minimize or prevent fouling of functionalities as herein described while not inhibiting or affecting the tripping mechanism or other functionalities of the breaker from functioning in the intended manner.

In yet further embodiments, the second and third segments have a top surface that is defined by a length ($L_{top}$) and each are defined by a width ($W_2$, $W_3$). The length and width of these segments are generally established so as to occlude or block significant portions of the open area extending outwardly from the top and bottom sides of the tripping mechanism (i.e., the area extending from the first and second side sections of the first segment) along the length of the tripping mechanism. In more particular embodiments, the length of the top surface ($L_{top}$) as described herein is generally maximized to cover significant portions of the tripping mechanism, more specifically the length is maximized based on the available length ($L_{link}$) of the link housing for the breaker. In more particular embodiments, the length ($L_{top}$) and widths ($W_2$, $W_3$) of the second and third segments also are established so as not to inhibit or affect the tripping mechanism or other functionalities of the breaker from functioning in the intended manner.

As also indicated herein, in embodiments of the present invention the top surface is arranged so as to form a sloping surface that slopes between a front end and rear end of the first segment. In more particular embodiments, the sloping angle ($\theta_1$) is determined based on the fit of shield or barrier to the link housing and the tripping mechanism as well as not inhibiting or affecting the tripping mechanism or functionalities of the breaker from functioning in the intended manner. In illustrative embodiments, the sloping angle $\theta_1$ satisfies one of the following relationships: $5° \leq \theta_1 \leq 20°$; $10° \leq \theta_1 \leq 15°$ or the $\theta_1 \approx 10°$ (i.e., sloping angle $\theta_1$ is about 10°).

It should be recognized that the above described lengths, widths and angles are not limiting as they are dependent upon the actual space that is available between the trip mechanism, the supporting structure of the breaker and between the shield, the trip mechanism and the supporting structure of the breaker.

While the foregoing has generally described the shield and barrier of the present invention as including three generally U-shaped structure this shall not be considered as limiting, as it is within the scope of the present invention for these three sub-structure to be combined in any of a number of ways known to those skilled in the art, to form three open ended structures. Also while the structures are illustrated as having straight lines and generally curved corners, this also shall not be limiting as these surfaces or lines can be arcuate or curved as well as being planar. For example, each of the second and third segments 220, 222 can be configured so as to form an arcuate member. Also while the segments and sections of the illustrated section are depicted as being solid, it is within the scope of the present invention for the segments and/or sections comprising the shield or barrier of the preset invention to be perforated so as to include through aperture, through slits or the like, so that pressurized air can flow in a limited fashion and at a much reduced pressure through such perforations.

Figure 4D:
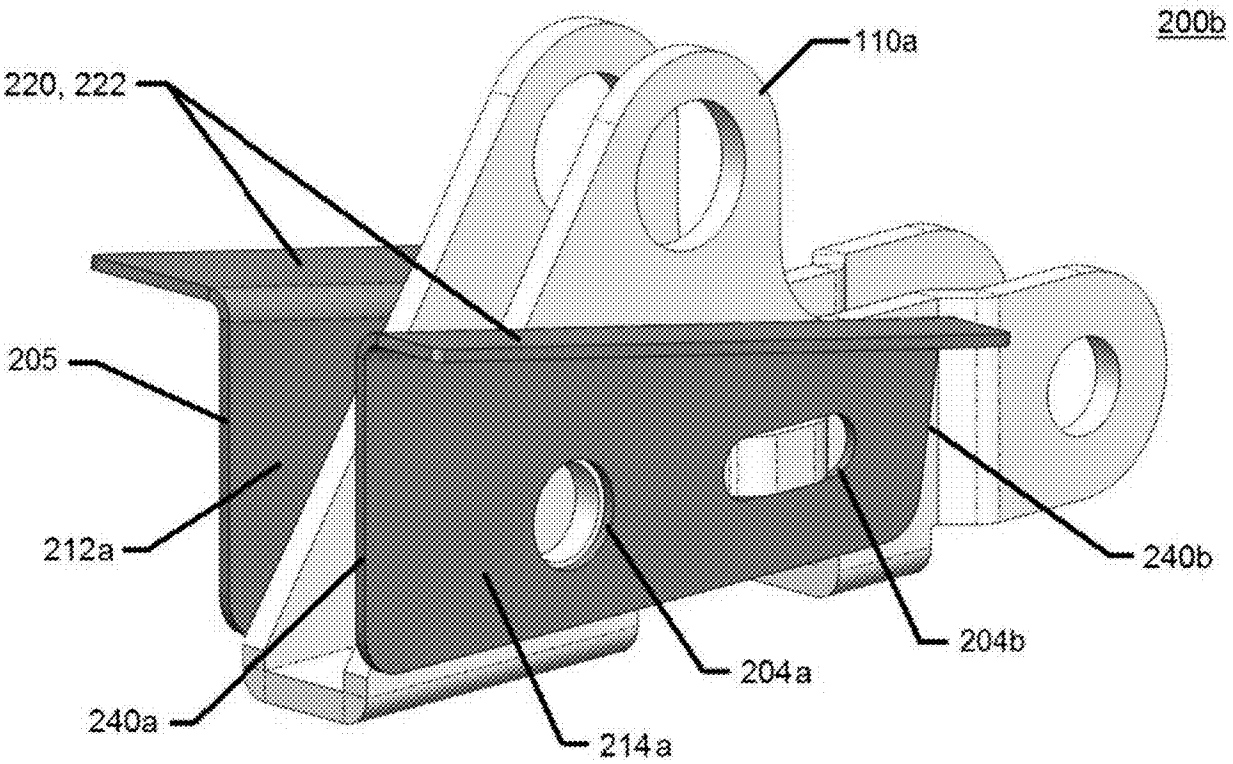
FIG. 4D is an axonometric view of a shield or barrier (e.g., a particulate and pressure redirection shield) according to another aspect/embodiment of the present invention.

Each of the above described shields and barriers, barriers are described as including two segments 230, 232 that oppose each other as well as forming the outside wall of the two side U shaped structures. While such a structure preferably redirect the pressurized gas flow and any particulate debris contained therein this shall not be limiting as it is within the scope of the present invention to further provide a shield 200*b* or barrier without these two segments as shown in FIG. 4D. In the case where these two segments 230, 232 are eliminated, the second and third segments 220, 222 preferably extend outwardly so that the gap, between the edge of the second and third segment and structure of the breaker and its enclosure in proximity, is such as to decrease the potential for any particulate debris created by the arc to directly pass through the gap. As a consequence, particulate debris traveling at an angle with respect to the second and third segments including the gap, interacts (e.g., bounces off the) with the shield and/or the structure of the breaker and its enclosure upstream of the second and third segments. Such interaction causes the particular debris to continue traveling at such angles and continuing the interactions with the shield and/or structure of the breaker and its enclosure.

In addition, the gap is established so as to cause the velocity of the pressurized gas to be reduced by pressure losses attributable to the presence of the gap. In this way, such interactions can result in the velocity of the particulate debris being reduced and this alone or in combination with the particulate debris traveling at an angle reduces the potential for particulate debris passing through the gap. Also, the reduced velocity resulting from the pressure loses caused by the gap also affects the level of penetration by particulate debris within the breaker.

Figure 4E:
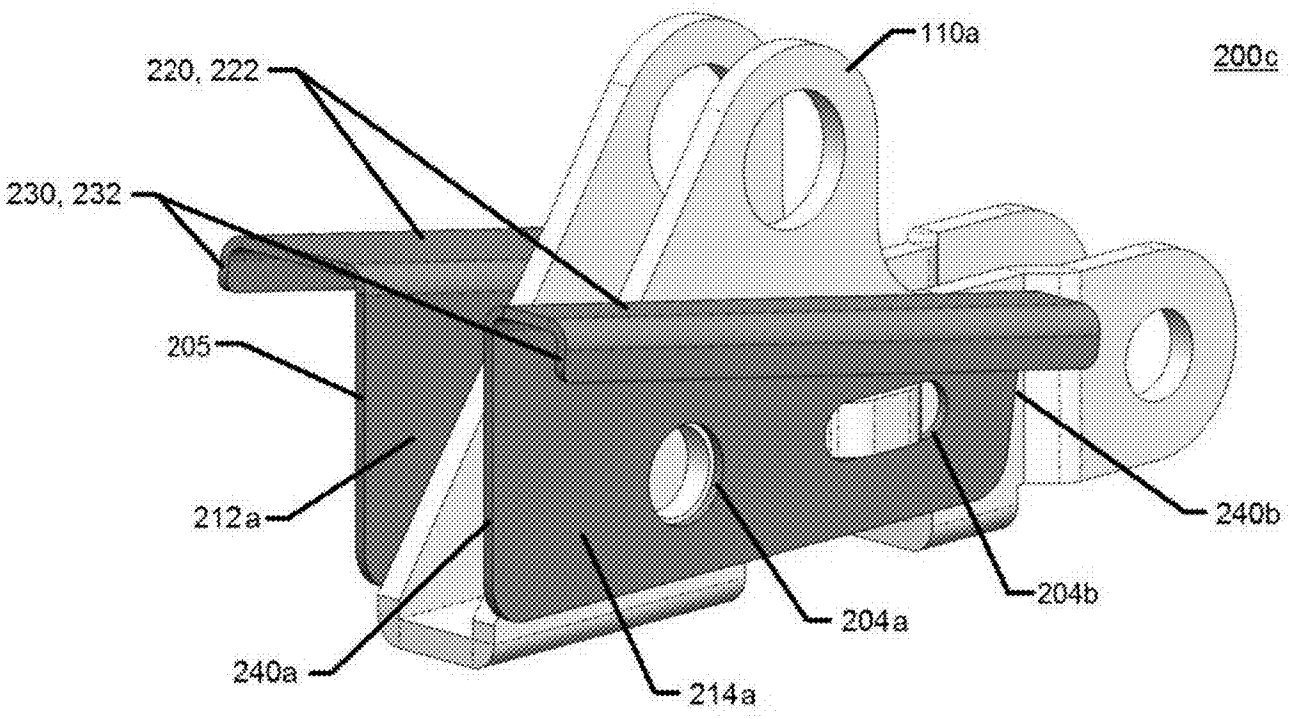
FIG. 4E is an axonometric view of a shield or barrier (e.g., a particulate and pressure redirection shield) according to yet another aspect/embodiment of the present invention.

In further embodiment and aspects of the present invention, such a shield 200*c* and barrier of the present invention can be arranged so as there is no central U-shaped structure and so as to include one or more side shields 205 or generally U-shaped structures that are secured to opposing sides of a portion of the tripping mechanism 110*a* as shown in FIGS. 4D-E. Reference shall be made to the foregoing discussion regarding FIGS. 4A-C for the details of the corresponding of feature of the shield not otherwise described below. The described embodiment differs from that shown in FIG. 4A in that the illustrated shield does not embody the bottom section 216.

In the illustrated embodiments, the side shields 205 are configured so as to include a securing mechanism that secures each of the first and second segments 212*a*, 214*a* to the tripping mechanism portion 110*a* and so as to maintain the orientation of each of the first and second segments with respect to the tripping mechanism portion. Such a securing mechanism can embody any of a number of techniques known in the art and appropriate for the intended use. In one particular embodiment, each of the first and second segments 212*a*, 214*a* are arranged so as to two openings 204*a, b* therein that are used to couple the respective first and second side segments to the tripping mechanism portion 110*a*. In one further particular embodiment, a pin, rivet or other device, such as that described above in connection with FIGS. 4A-C, securely passes through each opening 204*a, b* to secure one or both side sections 212*a, b*. In another particular embodiment, such as that illustrated in FIG. 4D-E, a pin, rivet or other device securely passes through one opening 204*a* and the other opening engages a feature of the tripping mechanism portion 110*a* thereby at least maintaining the orientation of the side section with respect to the tripping mechanism.

In yet a further embodiment, the pin, river or the like is configured so as to embody a structure that limits rotation of the side segments with respect to the tripping mechanism. For example, the rivet includes a shallot indentation that engages a finger provided in the opening 204*a* provided in the first and second side segments.

Figure 2A:
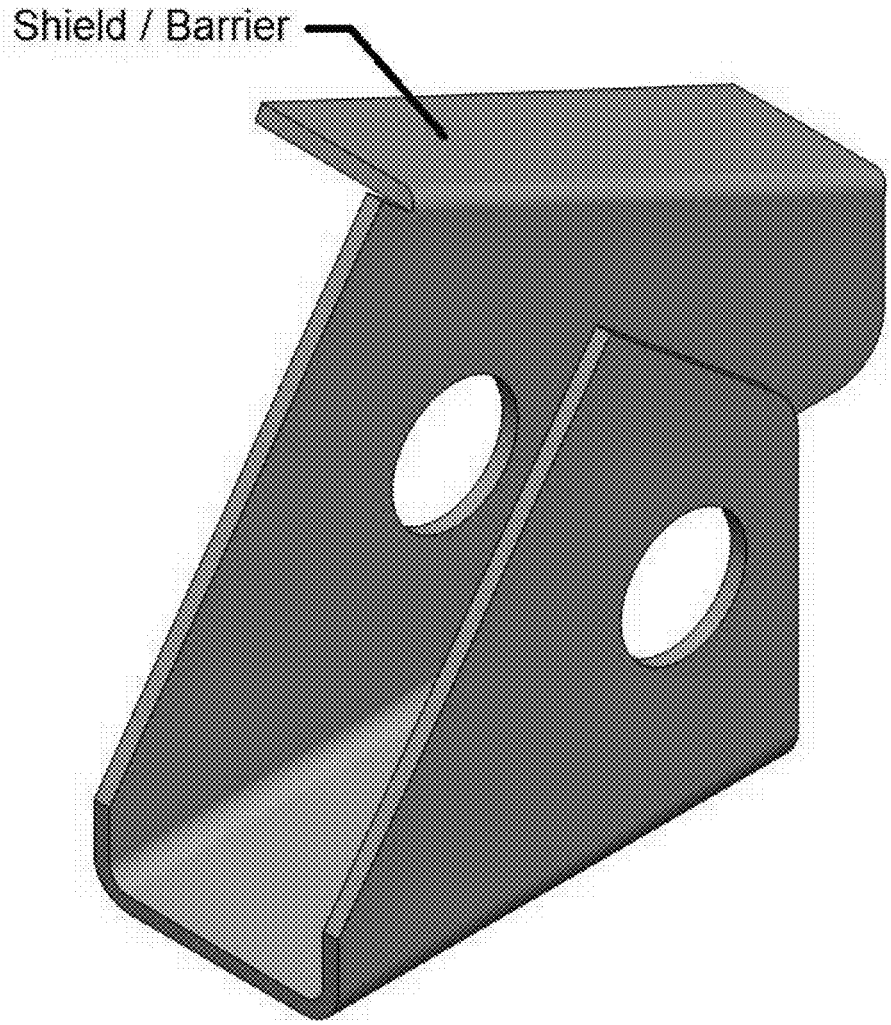
FIG. 2A is an axonometric view of a conventional shield/barrier for a trip mechanism of a breaker.
Figure 2B:
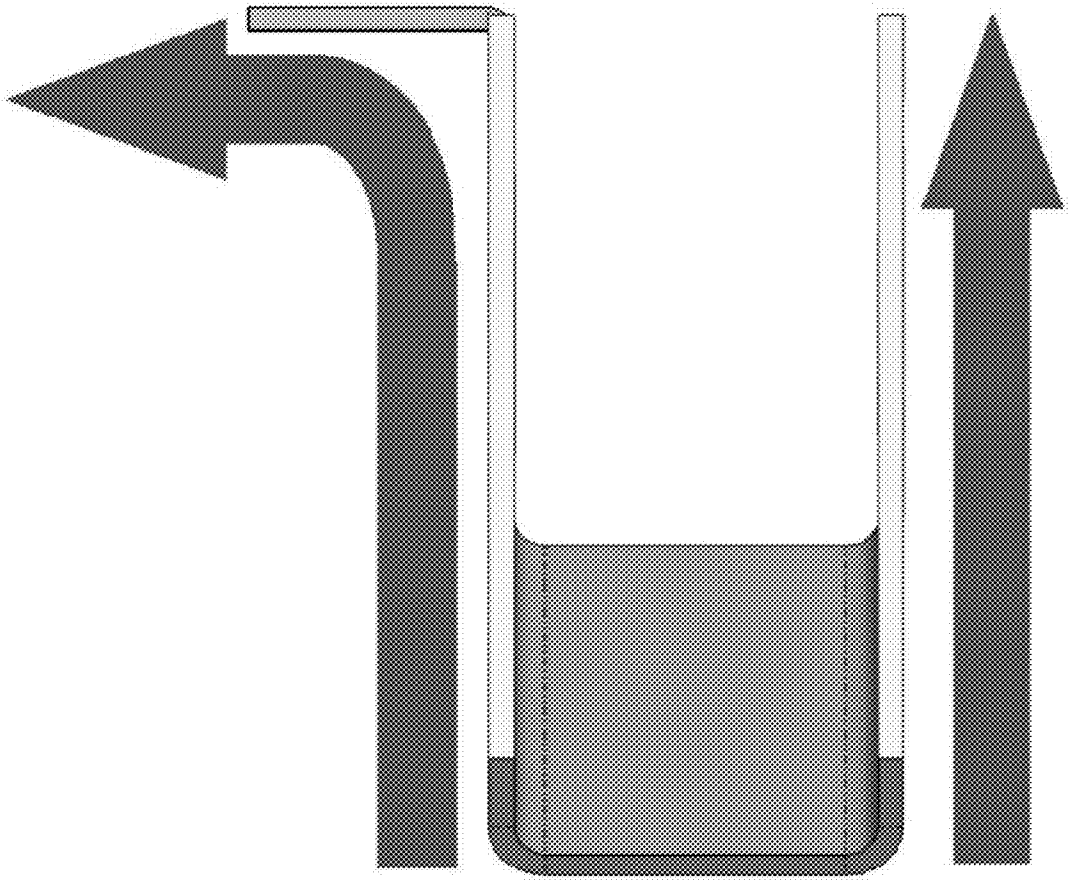
FIG. 2B is an illustrative view of the shield/barrier of FIG. 2A showing direction of flow paths about the conventional shield/barrier.
Figure 5:
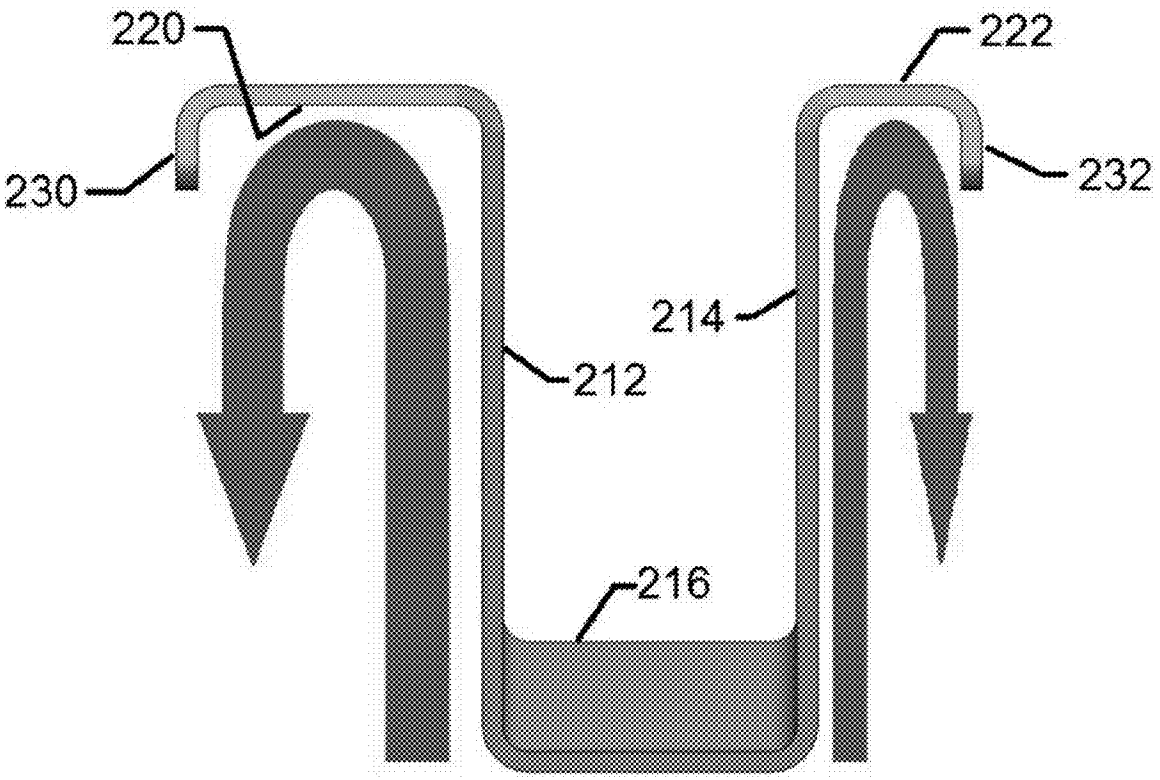
FIG. 5 is an illustrative view of the shield or barrier of FIG. 4A showing direction of flow paths about the shield.

The shield of the present invention is advantageous in numerous respects in particular when compared to a breaker embodying a conventional shield as described above. Referring now to FIG. 5, there is shown an illustrative view of the shield 200 of FIGS. 4A-C that shows the direction of the flow paths of the air with respect to the described shield. More particularly, the geometry and the effect of such geometry is different from the conventional shield (e.g., compare FIGS. 2A, B with FIG. 5). The shield 200 of the present invention includes five segments that are arranged so that the flow of pressurized air including any particulates (e.g., particulate debris) created by an arc or an arc event is re-directed away from the trip mechanism 110, as well as other functionalities of the breaker, and is pushed or directed toward the exit or exhaust vents 120 of the breaker. In addition the length of the shield 200 of the present invention is established so as to be significantly greater than that of the conventional shield thereby providing more coverage of the trip mechanism.

The result of these differences is that the shield of the present invention, as illustrated in FIG. 5, effectively redirects the pressurized air and any particulates being carried by the pressurized air away from the trip mechanism and other functionalities of the breaker (e.g., sear pin, upper armature). More specifically, the air is redirected by the outwardly extending second and third segments 220, 222 that are located on either side of the shield to block the flow of pressurized air. The fourth and fifth segments 230, 232 further redirects the flow of the air so that it is in essence forced back on itself and thus away from the trip mechanism and other areas of the breaker. In contrast, and as indicated herein, the conventional shield merely deflects the pressurized air and thus, the pressurized air and any particulate debris can pass around the conventional shield and enter into the trip mechanism and other areas of the breaker.

Example

A test was undertaken to illustrate and show the amount of particulate contamination that might occur with the trip mechanism, the sear pin and the upper armature for a breaker that has no shield and for a breaker including a shield according to the present invention. A pictorial view of a breaker with no shield is provided in FIG. 1. Reference also is made to FIG. 6, which shows a pictorial view of a magnetic breaker configured with a shield according to the present invention.

In this example, the length of the top surface is about 0.508 inches, the width of the second segment is about 0.109 inches, the width of the third segment is about 0.55 inches and the width of both the fourth and fifth segments is about 0.032 inches. It should be noted that manufacturing considerations in some cases dictated the dimensions for the width (e.g., minimum dimension necessary to allow bending of part). Also, the second and third segments are oriented so as to be essentially perpendicular to the respective side section of the first segment and the fourth and fifth segments are oriented so as to be essentially perpendicular to the respective second and third segment. More particularly, the first through fifth segments are oriented and arranged so as to form three U-shaped structure: a centrally located U-shaped structure and two outer U-shaped structures. More specifically, the first and fifth segments are oriented and arranged so that the open U of the centrally located U-shaped structure is opposite to the open U of the two outer U-shaped structures.

In comparison, and as discussed herein the conventional shield does not include a third, fourth or fifth segment and the top surface of the shield/barrier has a length of about 0.273 inches and a width of 0.074 inches. Thus, the geometry of the conventional shield is different from that of the example. In addition, the conventional shield is smaller in size and thus effect as compared to the example.

As to the physical comparison of the breaker with and without a shield, FIG. 1 (without shield) shows a significant amount of particulate contamination on the trip mechanism and the sear pin as well as the upper armature. In contrast, the breaker in FIG. 6 (with shield) shows a significant reduction in the amount of debris of these three functionalities. In addition, comparing the solenoid of FIG. 1 to that of FIG. 6 also shows that there is less contamination to the solenoid of FIG. 6.

Although a preferred embodiment of the invention has been described using specific terms, such description is for illustrative purposes only, and it is to be understood that changes and variations may be made without departing from the spirit or scope of the following claims.

INCORPORATION BY REFERENCE

All patents, published patent applications and other references disclosed herein are hereby expressly incorporated by reference in their entireties by reference.

EQUIVALENTS

Those skilled in the art will recognize, or be able to ascertain using no more than routine experimentation, many equivalents of the specific embodiments of the invention described herein. Such equivalents are intended to be encompassed by the following claims.

What is claimed is:

1. A pressure redirection barrier for an electrical breaker comprising a first segment including a first side section, a second side section and a bottom section the first and second side sections and bottom section being coupled to each other so as to form a first generally U-shaped structure;

a second segment being coupled to the first side section so as to extend outwardly from the first side section and at an angle with respect to the first side section;

a third segment being coupled to the second side section so as to extend outwardly from the second side section and at an angle with respect to the second side section;

a fourth segment being coupled to the second segment so as to extend outwardly from the second segment and at an angle with respect to the second segment such that gas flowing along a surface of the second segment is redirected at an angle with respect to the second segment surface; and a fifth segment being coupled to the third segment so as to extend outwardly from the third segment and at an angle with respect to the third segment such that gas flowing along a surface of the third segment is redirected at an angle with respect to the third segment surface.

2. The pressure redirection barrier of claim 1, wherein the first through fifth segments are sized and arranged such that the segments form a structure that directs a flow of pressurized gas towards exhaust ports of the breaker.

3. The pressure redirection barrier of claim 2, wherein particulate debris generated by an arc associated with an overload event are substantially redirected towards the exhaust ports.

4. The pressure redirection barrier of claim 1, wherein the second through fifth segments in combination with the respective first or second side sections are arranged so as to form respectively a second generally U-shaped structure and a third generally U-shaped structure.

5. The pressure redirection barrier of claim 4, wherein the second and third U-shaped structures are sized and arranged so that the gas is re-directed to flow in a direction generally opposite to the gas flowing across the surface of the first or second side sections.

6. The pressure redirection barrier of claim 4, wherein the first U-shaped structure is arranged so as to extend over significant portions of a trip mechanism of the breaker thereby directly shielding the trip mechanism.

7. The pressure redirection barrier of claim 4, wherein each of the second and third U-shaped structures are sized and arranged so as to occlude significant portions of open areas extending outwardly from opposing surfaces of the trip mechanism.

8. The pressure redirection barrier of claim 4, wherein each of the second and third U-shaped structures are sized and arranged so as to occlude significant portions of open areas otherwise extending outwardly from the first and second side sections of the first segment.

9. The pressure redirection barrier of claim 4, wherein the fourth and fifth segments are each sized and arranged so as to form an outer side of the respective second and third U-shaped structures and the first or second side sections of the first segment form respectively an opposing side of the second and a third U-shaped structures.

10. The pressure redirection barrier of claim 9, wherein the outer side and the opposing side are arranged so that the gas/particulates are re-directed to flow in a direction generally opposite to the gas flowing across the surface of the first or second side sections of the first segment.

11. The pressure redirection barrier of claim 1, wherein the fourth and fifth segments are each sized and arranged so that each segment extends sufficiently outwardly from the respective second and third segment so as to occlude the flow of the gas flowing across the surface of the respective second and third segment so as to at least minimize the gas from flowing around the respective second and third segments into certain open areas of the breaker.

12. The pressure redirection barrier of claim 1, wherein the fourth and fifth segments are each sized and arranged so that each segment extends lengthwise along a given length of the respective second and third segment so as to at least minimize the gas from flowing around the respective second and third segments into certain open areas of the breaker.

13. The pressure redirection barrier of claim 1, wherein the first segment further includes a front end and a rear end; and wherein the first and second side sections are configured such that an edge thereof slopes at an angle from the front end to the rear end, whereby a top surface for each of the second and third segments form a sloping surface.

14. The pressure redirection barrier of claim 1, further comprising a securing mechanism that secures the first segment to the electrical breaker so that the first through fifth segments are maintained in a desired relation with respect to a trip mechanism of the breaker.

15. An electrical breaker, comprising:

a tripping mechanism that is configured and arranged so as to interrupt current flow in the breaker upon detection of an unacceptable transient or operating condition; and a pressure redirection barrier arranged so as to be maintained in a desired orientation with respect to the tripping mechanism; wherein the pressure redirection barrier comprises:

a first segment including a first side section, a second side section and a bottom section the first and second side sections and bottom section being coupled to each other so as to form a first generally U-shaped structure;

a second segment being coupled to the first side section so as to extend outwardly from the first side section and at an angle with respect to the first side section;

a third segment being coupled to the second side section so as to extend outwardly from the second side section and at an angle with respect to the second side section;

a fourth segment being coupled to the second segment so as to extend outwardly from the second segment and at an angle with respect to the second segment such that gas flowing along a surface of the second segment is redirected at an angle with respect to the second segment surface; and a fifth segment being coupled to the third segment so as to extend outwardly from the third segment and at an angle with respect to the third segment such that gas flowing along a surface of the third segment is redirected at an angle with respect to the third segment surface.

16. The electrical breaker of claim 15, further including at least one exhaust port and wherein the first through fifth segments are sized such that the segments form a structure that re-directs a flow of pressurized gas, resulting from tripping of the electrical breaker, towards the at least one exhaust port.

17. The electrical breaker of claim 16, wherein the first through fifth segments are arranged so that particulate debris generated by an arc associated with a short circuit event are redirected towards the at least one exhaust port.

18. The electrical breaker of claim 15, wherein the second through fifth segments in combination with the respective first or second side sections are arranged so as to form respectively a second generally U-shaped structure and a third generally U-shaped structure.

19. The electrical breaker of claim 18, wherein the second and third U-shaped structures are sized and arranged so that the gas is re-directed to flow in a direction generally opposite to the gas flowing across the surface of the first or second side sections.

20. The electrical breaker of claim 18, wherein the first U-shaped structure is arranged so as to extend over significant portions of a trip mechanism of the breaker thereby directly shielding the trip mechanism and wherein each of the second and third U-shaped structures are sized and arranged so as to occlude significant portions of open areas extending outwardly from opposing surfaces of the trip mechanism.

21. The electrical breaker of claim 20, wherein each of the second and third U-shaped structures are sized and arranged so as to occlude significant portions of open areas otherwise extending outwardly from the first and second side sections of the first segment.

22. The electrical breaker of claim 18, wherein the fourth and fifth segments are each sized and arranged so as to form an outer side of the respective second and third U-shaped structures and the first or second side sections of the first segment form respectively an opposing side of the second and a third U-shaped structures.

23. The electrical breaker of claim 22, wherein the outer side and the opposing side are arranged so that the gas/particulates are re-directed to flow in a direction generally opposite to the gas flowing across the surface of the first or second side sections of the first segment.

24. The electrical breaker of claim 18, wherein the fourth and fifth segments are each sized and arranged:

so that each segment extends sufficiently outwardly from the respective second and third segment so as to occlude the flow of the gas flowing across the surface of the respective second and third segment so as to at least minimize the gas from flowing around the respective second and third segments into certain open areas of the breaker; and so that each segment extends lengthwise along a given length of the respective second and third segment so as to at least minimize the gas from flowing around the respective second and third segments into certain open areas of the breaker.

25. The electrical breaker of claim 15, wherein the first segment further includes a front end and a rear end; and wherein the first and second side sections are configured such that an edge thereof slopes at an angle from the front end to the rear end, whereby a top surface for each of the second and third segments forms a sloping surface.

26. The electrical breaker of claim 15, further comprising a securing mechanism that secures the first segment to the electrical breaker so that the first through fifth segments are maintained in the desired orientation with respect to the tripping mechanism.

27. A method for minimizing fouling of at least one functionality of an electrical breaker from effects resulting from tripping of the electrical breaker due to an overload event, where the breaker includes a tripping mechanism, said method comprising the steps of:

providing a barrier that is arranged so as to be maintained in a desired orientation with respect to the tripping mechanism;

wherein the provided barrier includes:

a first segment including a first side section, a second side section and a bottom section the first and second side sections and bottom section being coupled to each other so as to form a first generally U-shaped structure, a second segment being coupled to the first side section so as to extend outwardly from the first side section and at an angle with respect to the first side section, a third segment being coupled to the second side section so as to extend outwardly from the second side section and at an angle with respect to the second side section, a fourth segment being coupled to the second segment so as to extend outwardly from the second segment and at an angle with respect to the second segment such that gas flowing along a surface of the second segment is redirected at an angle with respect to the second segment surface, and a fifth segment being coupled to the third segment so as to extend outwardly from the third segment and at an angle with respect to the third segment such that gas flowing along a surface of the third segment is redirected at an angle with respect to the third segment surface; and arranging and sizing the first through fifth segments so as to form a structure that substantially re-directs a flow of pressurized gas, resulting from tripping of the electrical breaker away from certain areas of the breaker.

28. The method of claim 27, further comprising the step of:

arranging the second through fifth segments in combination with the respective first or second side sections of the first segment so as to form respectively a second generally U-shaped structure and a third generally U-shaped structure.

29. A pressure redirection barrier for an electrical breaker comprising at least one of a first side segment and a second side segment:

wherein the first side segment is arranged so as to be disposed along a first side of a tripping mechanism of the breaker and includes:

a first section and a second section coupled to the first section so as to extend outwardly from the first section and at an angle with respect to the first section, and a third section being coupled to the second section so as to extend outwardly from the second section and at an angle with respect to the second section such that gas flowing along a surface of the third section is redirected at an angle with respect to the third section surface; and wherein the second side segment is arranged so as to be disposed along an second side of the tripping mechanism of the breaker, the second side opposing the first side, and includes:

a fourth section and a fifth section coupled to the fourth section so as to extend outwardly from the fourth section and at an angle with respect to the fourth section, and a sixth section being coupled to the fifth section so as to extend outwardly from the fifth section and at an angle with respect to the fifth section such that gas flowing along a surface of the fifth section is redirected at an angle with respect to the fifth section surface.

30. The pressure redirection barrier of claim 29, further comprising both the first side segment and the second side segment.

31. The pressure redirection barrier of claim 29, wherein each of the first side segment and the second side segment is configured and arranged so as form a generally U-shaped structure section.

32. The pressure redirection barrier of claim 29, wherein:

the first, second and third sections are arranged so that the first and third sections oppose each other and so the three sections form an open ended structure; and the fourth, fifth and sixth sections are arranged so the third and sixth sections oppose each other and so the three sections form an opened ended structure.

33. The pressure redirection barrier of claim 29, further comprising a securing mechanism so as to secure each of the first and second segments to the tripping mechanism and so as to maintain the orientation of each of the first and second segments with respect to the tripping mechanism.

* * * * *